US011247809B2

(12) United States Patent
An et al.

(10) Patent No.: US 11,247,809 B2
(45) Date of Patent: Feb. 15, 2022

(54) PRESSURE RESISTANT BASIC SHELL, EASY OPEN END AND CAN WITH EASY OPEN END

(71) Applicant: SUZHOU SLAC PRECISION EQUIPMENT CO., LTD, Jiangsu (CN)

(72) Inventors: Shu An, Suzhou (CN); Bingsheng Wang, Suzhou (CN); Kang Xiong, Suzhou (CN); Weiwei Zhang, Suzhou (CN)

(73) Assignee: SUZHOU SLAC PRECISION EQUIPMENT CO., LTD, Suzhou (CN)

( * ) Notice: Subject to any disclaimer, the term of this patent is extended or adjusted under 35 U.S.C. 154(b) by 0 days.

(21) Appl. No.: 17/047,813

(22) PCT Filed: Jul. 25, 2018

(86) PCT No.: PCT/CN2018/097080

§ 371 (c)(1),
(2) Date: Oct. 15, 2020

(87) PCT Pub. No.: WO2019/200770

PCT Pub. Date: Oct. 24, 2019

(65) Prior Publication Data

US 2021/0139193 A1 May 13, 2021

(30) Foreign Application Priority Data

Apr. 16, 2018 (CN) ..... 201810336714.8

(51) Int. Cl.
*B65D 6/30* (2006.01)
*B65D 17/00* (2006.01)

(52) U.S. Cl.
CPC ..... *B65D 17/02* (2013.01); *B65D 17/08* (2013.01)

(58) Field of Classification Search
CPC ..... B65D 17/08; B65D 7/36
See application file for complete search history.

(56) References Cited

U.S. PATENT DOCUMENTS 8,490,825 B2 * 7/2013 Reed ..... B65D 17/08 220/623
8,573,020 B2 * 11/2013 Stodd ..... B21D 22/24 72/336

(Continued)

FOREIGN PATENT DOCUMENTS

CN 201530522 U 7/2010
CN 106672390 A 5/2017

(Continued)

OTHER PUBLICATIONS

Jan. 18, 2019 Search Report issued in International Patent Application No. PCT/CN2018/097080.

*Primary Examiner* — Allan D Stevens
(74) *Attorney, Agent, or Firm* — Oliff PLC

(57) ABSTRACT

A pressure resistant basic shell, easy open end and can with easy open end, wherein the basic shell consists of a can seaming portion, a countersink portion, a ferrule arc portion, an upward extension portion of ferrule and a center panel from periphery to center in the cross section; the countersink portion also consists of a sixth arc portion and a second straight portion, and the sixth arc portion and the second straight portion are connected in a tangent way, and the second straight portion and the ferrule arc portion are connected in a tangent way; the center of the sixth arc portion is located below the upper surface of the center (Continued)

panel. The break probability under the failure of pressure resistance is lowered to 0.05%~2.5%, which significantly improves the safety of use.

9 Claims, 2 Drawing Sheets

(56) References Cited

U.S. PATENT DOCUMENTS

| | | | | |
|---|---|---|---|---|
| 9,821,928 | B2 * | 11/2017 | Forrest | B65D 17/4012 |
| 10,967,412 | B2 * | 4/2021 | Mitchell | B21D 51/44 |
| 2005/0006395 | A1 * | 1/2005 | Reed | B21D 51/38<br>220/619 |
| 2005/0029269 | A1 * | 2/2005 | Stodd | B65D 7/36<br>220/619 |
| 2005/0252922 | A1 * | 11/2005 | Reed | B65D 17/08<br>220/619 |
| 2014/0353318 | A1 * | 12/2014 | Fields | B21D 51/2661<br>220/619 |

FOREIGN PATENT DOCUMENTS

| | | | | |
|---|---|---|---|---|
| CN | 206766576 | U | 12/2017 | |
| DE | 296 19 458 | U1 | 1/1997 | |
| WO | 94/06697 | A1 | 3/1994 | |
| WO | WO-2012039433 | A1 * | 3/2012 | B65D 17/08 |

* cited by examiner

PRESSURE RESISTANT BASIC SHELL, EASY OPEN END AND CAN WITH EASY OPEN END

TECHNICAL FIELD

This invention relates to a basic shell, easy open end and can, especially a pressure resistant basic shell, easy open end and can with easy open end.

BACKGROUND OF INVENTION

The easy open end was invented in last century 60's, and it was widely used in supporting packages for beverage cans and beer cans. Due to its advantages of light weight, small size and repeated use of waste, the easy open end was widely promoted worldwide and the huge production scale was formed. With the increasing demand for easy open ends, the easy open end industry was developed rapidly and the competition became more and more severe. Therefore, in order to save the resources, reduce the cost and meet the needs of market competition, the research and development of pressure resistant easy open end saving materials is not only the demand of enterprise survival and development, but also the certainty of market economic development.

In the prior art, a typical structure is shown in the prior art CN106672390A previously filed by the applicant of the present application. The easy open end structure disclosed in this patent is: it consists of the body and pull ring riveted to the body; the body consists of a can seaming portion, a countersink portion, a ferrule arc portion, an upward extension portion of ferrule and a center panel from periphery to center in the cross section, and the countersink portion and the extension portion forms a circular recess; the countersink is directly connected by the first straight portion, fourth arc portion and fifth arc portion and the end of fifth arc portion is directly connected with the end of ferrule arc section in an externally tangent way; and the upward extension portion of ferrule consists of the second straight portion and seventh arc section and the seventh arc section is connected with the center panel in a tangent way. The patented solution has good pressure resistance performance under the premise of saving materials, but the following deficiencies are still found in actual production:

I. As the countersink portion is only connected by the first straight portion, fourth arc portion and fifth arc portion and the fourth arc portion and fifth arc portion are connected in an externally tangent way, when the test pressure reaches the limit value during a pressure test, more than 80% of the countersink portion of body may be cracked and the use safety is poor, that is, the fifth arc portion of body will be broken when the pressure exceeds the limit in the actual use and the liquid in the can will be splashed;

II. As the connection of countersink portion and ferrule arc section is the externally tangent connection of arc to arc, the contact area of basic shell and can seaming mould (commonly known as seaming head) is too small and it's only the line contact, which results in the instability of can seaming and could not ensure the quality of can seaming.

DISCLOSURE OF THE INVENTION

The purpose of present invention is to provide a pressure resistant basic shell, easy open end and can with easy open end to lower the probability of breakage due to the failure of pressure resistance and improve the use safety and stability of can seaming under the premise of unchanged material thickness and pressure resistance value.

In order to achieve the purpose, the technical solution of basic shell applied by the present invention is: a pressure resistant basic shell consists of a can seaming portion, a countersink portion, a ferrule arc portion, an upward extension portion of ferrule and a center panel from periphery to center in the cross section; the countersink portion consists of the first straight portion, fourth arc portion and fifth arc portion, and the first end of first straight portion is connected with the corresponding end of seaming portion, and its second end is connected with the first end of fourth arc portion and the first straight portion is connected with the fourth arc portion in a tangent way; the second end of fourth arc portion is connected with the first end of fifth arc portion and the fourth arc portion and fifth arc portion are connected in an externally tangent way; the countersink portion also consists of a sixth arc portion and a second straight portion, and the second end of the fifth arc portion is connected with the first end of the sixth arc portion and the fifth arc portion and the sixth arc portion are connected in an internally tangent way; the second end of the sixth arc portion is connected with the first end of the second straight portion, and the sixth arc portion and the second straight portion are connected in a tangent way; the second end of the second straight portion is connected with the first end of the ferrule arc section and the second straight portion and the ferrule arc section are connected in a tangent way;

The radius of the fifth arc portion is greater than or equal to 0.25 mm and less than or equal to 2.5 mm;

The radius of the sixth arc portion is greater than or equal to 2 mm and less than or equal to 6.5 mm;

The radius of the ferrule arc portion is greater than or equal to 0.25 mm and less than or equal to 0.8 mm;

The junction of second straight portion and ferrule arc portion is defined as the auxiliary point, and the straight line vertical to the center panel through auxiliary point is defined as the auxiliary line A; the fifth arc portion, sixth arc portion and second straight portion are located at one side of the auxiliary line A and the ferrule arc section is located at the other side of the auxiliary line A;

The direction of the auxiliary line A is defined as up and down direction, and the side of basic shell facing the outside of can is up and the side of basic shell facing the inside of the can is down; in the up and down direction, the center of the sixth arc portion is located below the upper surface of the center panel;

The projection distance between the center of fourth arc portion and center of the fifth arc portion on the auxiliary line A is greater than or equal to 0.85 times of the sum of the radius of the fourth arc portion and the radius of the fifth arc portion, and less than or equal to the sum of the radius of the fourth arc portion and the radius of the fifth arc portion;

The projection distance between the center of fourth arc portion and center of the fifth arc portion perpendicular to the auxiliary line A is greater than or equal to 0, and less than or equal to 0.5 times of the sum of the radius of the fourth arc portion and the radius of the fifth arc portion.

Further, in the up and down direction, the junction of sixth arc portion and second straight portion is located below the upper surface of the center panel.

Further, the angle between the second straight portion and the auxiliary line A is 5°~12°.

In order to achieve the above purpose, the technical solution for easy open end adopted by the present invention is: a pressure resistant easy open end, which consists of a basic shell and pull ring and the basic shell adopts the above-mentioned technical solution for the basic shell.

Further, in the up and down direction, the junction of sixth arc portion and second straight portion is located below the upper surface of the center panel.

Further, the angle between the second straight portion and the auxiliary line A is 5°~12°.

In order to achieve the above purpose, the technical solution for can adopted by the present invention is: a pressure resistant can, which consists of a can shell and easy open end and the easy open end consists of a basic shell and pull ring and the basic shell adopts the above-mentioned technical solution for the basic shell.

Further, in the up and down direction, the junction of sixth arc portion and second straight portion is located below the upper surface of the center panel.

Further, the angle between the second straight portion and the auxiliary line A is 5°~12°.

The design principle of the present invention is: the present invention is developed through the detailed research on the basis of the prior art for a whole year to find the effective method to lower the probability of breakage due to the failure of pressure resistance: add a sixth arc portion R6 and a second straight portion L2 for the countersink portion, get the reasonable dimension of fifth arc portion R5 and sixth arc portion R6 and the position relationship of centers of fourth arc portion R4 and fifth arc portion R5 through the detailed research to finally and successfully lower the probability of breakage to 0.05%~2.5% due to the failure of pressure resistance. It has significantly improved the safety of use.

Under the same pressure resistance test conditions, the basic shells of prior art mostly break as shown in the FIG. 3 with the breakage probability of 80%; the basic shells of the embodiment in the present invention maintains the plump state, but doesn't break as shown in FIG. 4 and the breakage probability is only 0.05%~2.5%.

The pressure resistance test comparison between the prior art and present invention is shown as follows:

Prior art
Material thickness 0.218 mm

| No. | Pressure resistance before cooking (PSI) | Pressure resistance after cooking (PSI) |
|---|---|---|
| 1 | 102.21 | 91.59 |
| 2 | 101.41 | 93.79 |
| 3 | 102.76 | 92.29 |
| 4 | 102.15 | 92.88 |
| 5 | 102.20 | 93.79 |
| 6 | 102.36 | 93.87 |
| 7 | 102.79 | 93.42 |
| 8 | 102.88 | 93.87 |
| 9 | 103.40 | 94.84 |
| 10 | 102.78 | 91.65 |
| 11 | 103.56 | 92.12 |
| 12 | 101.32 | 91.98 |
| 13 | 102.55 | 92.45 |
| 14 | 103.65 | 92.05 |
| 15 | 102.88 | 93.87 |
| 16 | 103.81 | 92.55 |
| 17 | 101.32 | 93.18 |
| 18 | 102.78 | 92.34 |
| 19 | 102.50 | 91.04 |
| 20 | 102.25 | 94.94 |

-continued

Prior art
Material thickness 0.218 mm

| No. | Pressure resistance before cooking (PSI) | Pressure resistance after cooking (PSI) |
|---|---|---|
| Minimum value | 101.32 | 91.04 |
| Maximum value | 103.81 | 94.94 |
| Average value | 102.58 | 92.93 |

Breakage quantity during pressure resistance test of sample of prior art

| | Before cooking | After cooking |
|---|---|---|
| Quantity | 18 | 14 |

Embodiment of present invention
Material thickness 0.218 mm

| No. | Pressure resistance before cooking (PSI) | Pressure resistance after cooking (PSI) |
|---|---|---|
| 1 | 108.45 | 98.55 |
| 2 | 107.60 | 97.39 |
| 3 | 107.76 | 99.87 |
| 4 | 108.77 | 97.25 |
| 5 | 109.20 | 98.12 |
| 6 | 108.45 | 97.65 |
| 7 | 107.55 | 98.23 |
| 8 | 107.65 | 98.47 |
| 9 | 108.12 | 99.28 |
| 10 | 107.98 | 98.55 |
| 11 | 108.32 | 97.89 |
| 12 | 108.45 | 99.01 |
| 13 | 108.09 | 99.56 |
| 14 | 109.56 | 97.80 |
| 15 | 107.38 | 97.45 |
| 16 | 107.56 | 98.56 |
| 17 | 107.23 | 97.89 |
| 18 | 108.78 | 97.39 |
| 19 | 108.67 | 99.45 |
| 20 | 107.89 | 97.32 |
| Minimum value | 107.23 | 97.25 |
| Maximum value | 109.56 | 99.87 |
| Average value | 108.19 | 98.31 |

Breakage quantity during pressure resistance test of sample of embodiment of present invention

| | Before cooking | After cooking |
|---|---|---|
| Quantity | 1 | 0 |

On the other hand, as shown in FIG. 2, the second straight portion L2 of basic shell of present invention could form the surface contact with the can seaming mould 2 (commonly known as seaming head) during the can seaming to increase the contact area and significantly improve the stability of can seaming.

The present invention seems uncomplicated, but it brings about the above-mentioned unexpected effect, which is an important breakthrough in this field.

SPECIFIC EMBODIMENT

With reference to the accompanying drawings and embodiment, the present invention will be described in detail.

Figure 1:
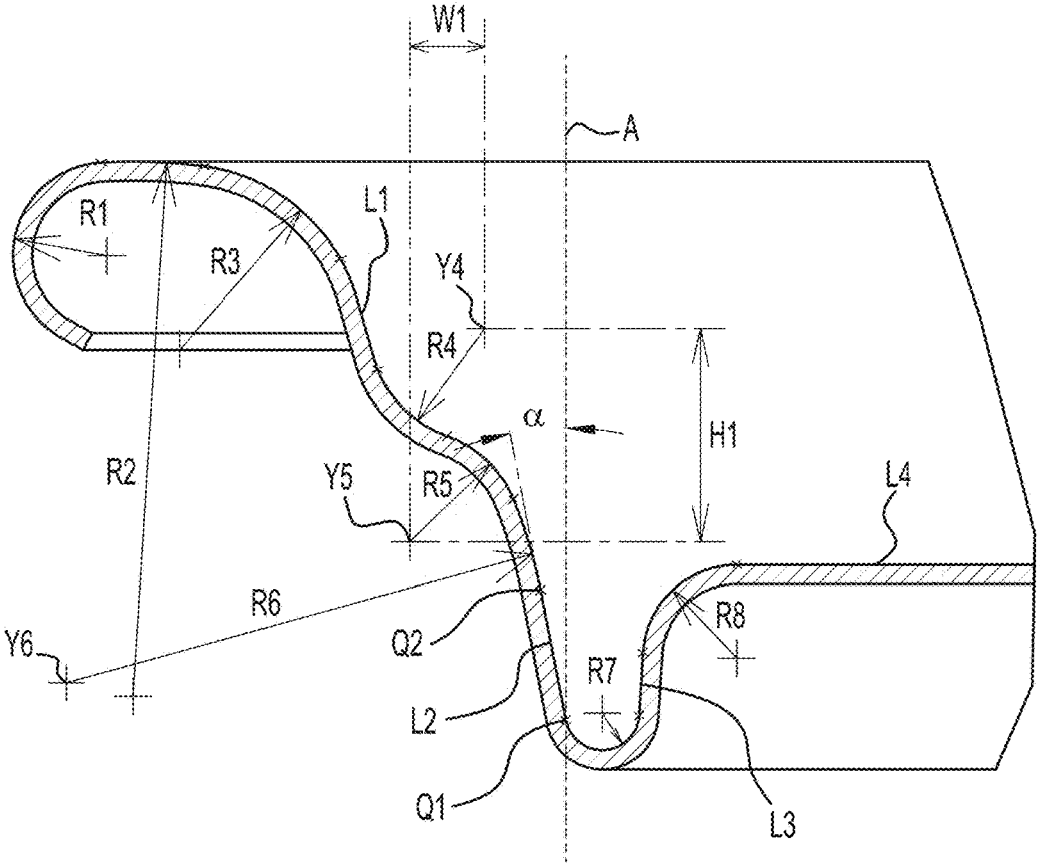
FIG. 1 is the schematic view of cross-section of the basic shell of embodiment 1 of present invention.

Embodiment 1: refer to FIG. 1 for a pressure resistant basic shell:

A pressure resistant basic shell as shown in the FIG. 1 consists of a can seaming portion, a countersink portion, a ferrule arc portion R7, an upward extension portion of ferrule and a center panel.

As shown in the FIG. 1, the can seaming portion consists of first arc portion R1, second arc portion R2 and third arc portion R3, which are connected in sequence, and the first arc portion R1 is internally tangent to the second arc portion R2, and the second arc portion R2 is internally tangent to the third arc portion R3.

As shown in the FIG. 1, the countersink portion consists of a first straight portion L1, a fourth arc portion R4 and a fifth arc portion R5, and the first end of first straight portion L1 is connected with the corresponding end of can seaming portion, the second end is connected with the first end of fourth arc portion R4 and the first straight portion L1 is tangent to the fourth arc portion R4; the second end of fourth arc portion R4 is connected with the first end of fifth arc portion R5 and the fourth arc portion R4 is externally tangent to the fifth arc portion R5. The main point of the embodiment is: the countersink portion also consists of a sixth arc portion R6 and a second straight portion L2, and the second end of the fifth arc portion R5 is connected with the first end of the sixth arc portion R6 and the fifth arc portion R5 and the sixth arc portion R6 are connected in an internally tangent way; the second end of the sixth arc portion R6 is connected with the first end of the second straight portion L2, and the sixth arc portion R6 and the second straight portion L2 are connected in a tangent way. And the second end of the second straight portion L2 is connected with the first end of the ferrule arc section R7 and the second straight portion L2 and the ferrule arc section R7 are connected in a tangent way.

The radius of the fifth arc portion R5 is greater than or equal to 0.25 mm and less than or equal to 2.5 mm; the radius of the sixth arc portion R6 is greater than or equal to 2 mm and less than or equal to 6.5 mm; the radius of the ferrule arc section R7 is greater than or equal to 0.25 mm and less than or equal to 0.8 mm.

As shown in the FIG. 1, the junction of second straight portion L2 and ferrule arc portion R7 is defined as the auxiliary point Q1, and the straight line vertical to the center panel through auxiliary point Q1 is defined as the auxiliary line A; the fifth arc portion R5, sixth arc portion R6 and second straight portion L2 are located at one side of the auxiliary line A and the ferrule arc section R7 is located at the other side of the auxiliary line A.

As shown in the FIG. 1, the direction of the auxiliary line A is defined as up and down direction, and the side of basic shell facing the outside of can is up and the side of basic shell facing the inside of the can is down; in the up and down direction, the center Y6 of the sixth arc portion R6 is located below the upper surface of the center panel L4; As shown in the FIG. 1, the projection distance H1 between the center Y4 of specific fourth arc portion R4 and center Y5 of the fifth arc portion R5 on the auxiliary line A is greater than or equal to 0.85 times of the sum of the radius of the fourth arc portion R4 and the radius of the fifth arc portion R5, and less than or equal to the sum of the radius of the fourth arc portion R4 and the radius of the fifth arc portion R5.

The projection distance W1 between the center Y4 of fourth arc portion R4 and center Y5 of the fifth arc portion R5 perpendicular to the auxiliary line A is greater than or equal to 0, and less than or equal to 0.5 times of the sum of the radius of the fourth arc portion R4 and the radius of the fifth arc portion R5.

As shown in the FIG. 1, it is preferred: in the up and down direction, the junction Q2 of sixth arc portion R6 and second straight portion L2 is located below the upper surface of the center panel L4, and it could achieve the better anti-breakage performance.

As shown in the FIG. 1, it is preferred: the angle $\alpha$ between the second straight portion L2 and the auxiliary line A is 5°~12°.

The upward extension portion of ferrule consists of a third straight portion L3 and a eighth arc portion R8, and one end of the third straight portion L3 is connected with the ferrule arc section R7 in a tangent way, and its second end is connected with the eighth arc portion R8 in a tangent way, and the second end of the eighth arc portion R8 is connected with the center panel L4 in a tangent way. A center panel L4 could be a flat surface and could also be a substantially flat surface including a partially curved surface.

In the above embodiment, the dimension of the "arc portion" and "straight portion" refers to the dimension of the portion on the surface of the basic shell facing the outside of can (i.e. the up direction in the FIG. 1).

Figure 2:
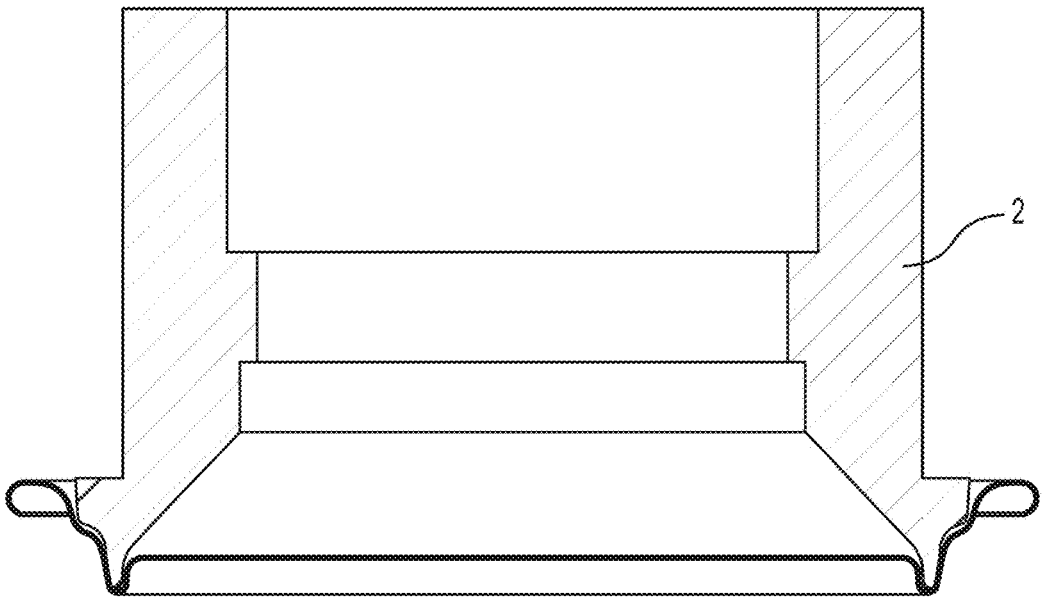
FIG. 2 is the schematic view of the joining of the basic shell of embodiment 1 of present invention with the can seaming mould during the can seaming.
Figure 3:
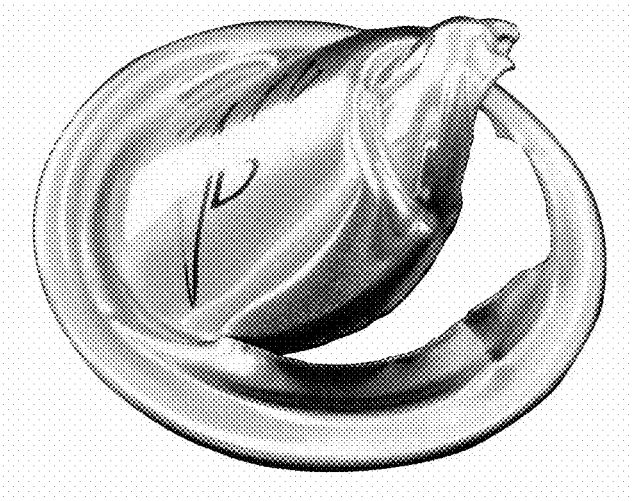
FIG. 3 Prior Art
FIG. 3 is the photo of the state after the pressure resistance test of the basic shell of prior art.
Figure 4:
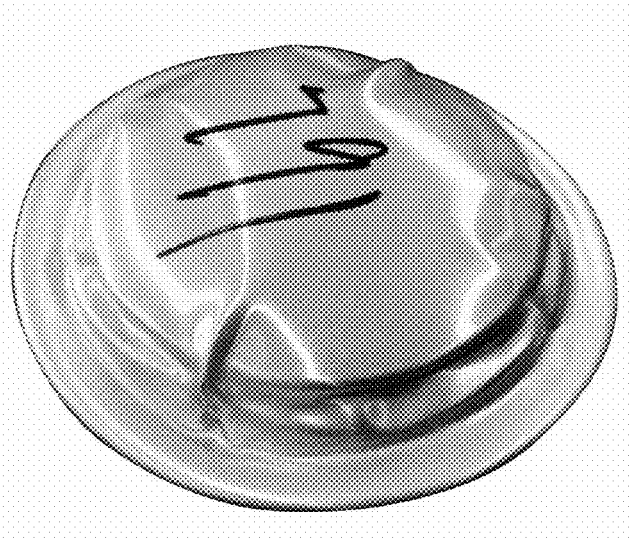
FIG. 4 is the photo of the state after the pressure resistance test of the basic shell of embodiment of present invention.

The break probability under the failure of pressure resistance of this embodiment is only 0.05%~2.5%, which significantly improves the safety of use. Furthermore, as shown in FIG. 2, the second straight portion L2 of basic shell of present invention could form the surface contact with the can seaming mould 2 (commonly known as seaming head) during the can seaming to increase the contact area and significantly improve the stability of can seaming.

Embodiment 2: a pressure resistant easy open end, which consists of a basic shell and pull ring and the basic shell structure is the same as that described in embodiment 1 and will not be described here.

Embodiment 3: a pressure resistant can, which consists of a can shell and easy open end and the easy open end consists of a basic shell and pull ring, and the basic shell structure is the same as that described in embodiment 1 and will not be described here.

It should be noted that the above described embodiments are only for illustration of technical concept and characteristics of present invention with purpose of making those skilled in the art understand the present invention, and thus these embodiments shall not limit the protection range of present invention. The equivalent changes or modifications according to spiritual essence of present invention shall fall in the protection scope of present invention.

The invention claimed is:

1. A pressure resistant basic shell consists of a can seaming portion, a countersink portion, a ferrule arc portion, an upward extension portion of ferrule and a center panel from periphery to center in the cross section;

the countersink portion consists of a first straight portion, a fourth arc portion and a fifth arc portion, and the first end of first straight portion is connected with the corresponding end of seaming portion, and the second end of the first straight portion is connected with the first end of fourth arc portion and the first straight portion is connected with the fourth arc portion in a tangent way;

the second end of fourth arc portion is connected with the first end of fifth arc portion and the fourth arc portion and fifth arc portion are connected in an externally tangent way; wherein:

the countersink portion also consists of a sixth arc portion and a second straight portion, and the second end of the fifth arc portion is connected with the first end of the sixth arc portion and the fifth arc portion and the sixth arc portion are connected in an internally tangent way;

the second end of the sixth arc portion is connected with the first end of the second straight portion, and the sixth arc portion and the second straight portion are connected in a tangent way;

the second end of the second straight portion is connected with the first end of the ferrule arc portion and the second straight portion and the ferrule arc portion are connected in a tangent way;

the radius of the fifth arc portion is greater than or equal to 0.25 mm and less than or equal to 2.5 mm;

the radius of the sixth arc portion is greater than or equal to 2 mm and less than or equal to 6.5 mm;

the radius of the ferrule arc portion is greater than or equal to 0.25 mm and less than or equal to 0.8 mm;

the junction of second straight portion and ferrule arc portion is defined as an auxiliary point, and a straight line vertical to the center panel through the auxiliary point is defined as an auxiliary line;

the fifth arc portion, sixth arc portion and second straight portion are located at one side of the auxiliary line and the ferrule arc portion is located at the other side of the auxiliary line;

the auxiliary line defines the up and down directions, wherein the concavity of the ferrule arc portion faces the up direction and the convexity of the ferrule arc portion faces the down direction; in the up and down direction, the center of the sixth arc portion is located below an upper surface of the center panel;

the projection distance between the center of fourth arc portion and center of the fifth arc portion on the auxiliary line is greater than or equal to 0.85 times of the sum of the radius of the fourth arc portion and the radius of the fifth arc portion, and less than or equal to the sum of the radius of the fourth arc portion and the radius of the fifth arc portion;

the projection distance between the center of fourth arc portion and center of the fifth arc portion perpendicular to the auxiliary line is greater than or equal to 0, and less than or equal to 0.5 times of the sum of the radius of the fourth arc portion and the radius of the fifth arc portion.

2. The pressure resistant basic shell as claimed in claim 1, wherein:

in the up and down direction, the junction of sixth arc portion and second straight portion is located below the upper surface of the center panel.

3. The pressure resistant basic shell as claimed in claim 1, wherein:

the angle between the second straight portion and the auxiliary line is 5°~12°.

4. A pressure resistant easy open end consists of a basic shell and pull ring wherein:

the basic shell is the one as described in claim 1.

5. The pressure resistant easy open end as claimed in claim 4, wherein:

in the up and down direction, the junction of sixth arc portion and second straight portion is located below the upper surface of the center panel.

6. The pressure resistant easy open end as claimed in claim 4, wherein:

the angle between the second straight portion and the auxiliary line is 5°~12°.

7. A pressure resistant can consists of a can shell and easy open end and the easy open end consists of a basic shell and pull ring wherein:

the basic shell is the one as described in claim 1.

8. The pressure resistant can as claimed in claim 7, wherein:

in the up and down direction, the junction of sixth arc portion and second straight portion is located below the upper surface of the center panel.

9. The pressure resistant can as claimed in claim 7, wherein:

the angle between the second straight portion and the auxiliary line is 5°~12°.

* * * * *